US007435035B2

(12) United States Patent
Cullen

(10) Patent No.: US 7,435,035 B2
(45) Date of Patent: Oct. 14, 2008

(54) WATERTIGHT GATE HAVING GATE LEAF CONNECTED TO FOLDABLE SUPPORT

(75) Inventor: Martin Cullen, Glasgow (GB)

(73) Assignee: University Court of Glasgow Caledonian University, Glasgow, Scotland (GB)

( * ) Notice: Subject to any disclaimer, the term of this patent is extended or adjusted under 35 U.S.C. 154(b) by 0 days.

(21) Appl. No.: 10/495,481

(22) PCT Filed: Nov. 11, 2002

(86) PCT No.: PCT/GB02/05067

§ 371 (c)(1),
(2), (4) Date: May 13, 2004

(87) PCT Pub. No.: WO03/042460

PCT Pub. Date: May 22, 2003

(65) Prior Publication Data

US 2005/0002737 A1 Jan. 6, 2005

(30) Foreign Application Priority Data

Nov. 13, 2001 (GB) ..... 0127216.0

(51) Int. Cl.
*E02C 1/00* (2006.01)
*E02B 7/44* (2006.01)

(52) U.S. Cl. ..... 405/85; 405/99

(58) Field of Classification Search ..... 405/84–89, 405/92, 99, 100, 103, 104, 106
See application file for complete search history.

(56) References Cited

U.S. PATENT DOCUMENTS 18,555 A * 11/1857 Seely ..... 405/99
176,055 A * 4/1876 Reed ..... 405/85
193,885 A * 8/1877 Marshall ..... 405/85
227,563 A * 5/1880 Milette ..... 405/85
269,712 A * 12/1882 Renk ..... 405/99
303,807 A * 8/1884 Coiseau ..... 405/85
385,359 A * 7/1888 Kirk ..... 405/85
454,877 A * 6/1891 Merriam ..... 405/73
511,516 A * 12/1893 Dean ..... 405/94
535,153 A * 3/1895 Witcher ..... 405/91
610,548 A * 9/1898 Manny ..... 405/85

(Continued)

FOREIGN PATENT DOCUMENTS

FR 2 044 503 A * 2/1971

(Continued)

*Primary Examiner*—Gay A Spahn
(74) *Attorney, Agent, or Firm*—K&L Gates LLP

(57) ABSTRACT

An improved watertight gate for use in a port or canal is described. The watertight gate generally comprising two gate leaves and associated with each gate leaf is a foldable support structure and a gate position controller. The gate position controller interacts with the foldable support structure so as to move the associated gate leaf between an open and a closed position. By employing the gate position controller and the foldable support structure to control the gates the efficiency of the watertight seal provided by the gate is independent of water pressure produced by the surrounding bodies of water. Adjustable mounts attach the foldable support structures. These adjustable mounts provide for adjustment of the alignment of the watertight gate so minimizing the problems of installation alignment and reduced efficiency through wear and tear.

3 Claims, 4 Drawing Sheets

U.S. PATENT DOCUMENTS

| | | | | | |
|---|---|---|---|---|---|
| 625,506 | A | * | 5/1899 | Hone | 405/92 |
| 664,078 | A | * | 12/1900 | Frank et al. | 49/10 |
| 674,629 | A | * | 5/1901 | Guthrie | 405/85 |
| 862,066 | A | * | 7/1907 | Fitch | 405/85 |
| 1,030,580 | A | * | 6/1912 | Gowan | 405/85 |
| 1,272,933 | A | * | 7/1918 | Fitts | 251/89 |
| 1,377,921 | A | * | 5/1921 | Peterson | 405/101 |
| 1,389,212 | A | * | 8/1921 | Parker | 405/92 |
| 1,404,969 | A | * | 1/1922 | Kassebaum | 405/102 |
| 1,533,137 | A | * | 4/1925 | Pospisil | 405/98 |
| 1,645,913 | A | * | 10/1927 | McCandless | 405/90 |
| 1,754,108 | A | * | 4/1930 | Jermar | 405/102 |
| 2,119,540 | A | * | 6/1938 | Holmes et al. | 405/82 |
| 2,342,740 | A | * | 2/1944 | La Breche et al. | 405/85 |
| 2,584,364 | A | * | 2/1952 | Osborn | 405/92 |
| 2,654,225 | A | * | 10/1953 | Saunders et al. | 405/90 |
| 2,664,713 | A | * | 1/1954 | Baker | 405/91 |
| 2,680,351 | A | * | 6/1954 | Jaramillo | 405/92 |
| 3,083,539 | A | * | 4/1963 | Foster | 405/6 |
| 3,091,934 | A | * | 6/1963 | Jacobs | 405/91 |
| 3,173,269 | A | * | 3/1965 | Imbertson | 405/87 |
| 3,333,423 | A | * | 8/1967 | Cook, Jr. | 405/100 |
| 3,345,823 | A | * | 10/1967 | Rakcevic | 405/99 |
| 3,756,032 | A | * | 9/1973 | Solinas | 405/92 |
| 4,073,147 | A | * | 2/1978 | Nomura | 405/94 |
| 4,146,346 | A | * | 3/1979 | Salo | 405/80 |
| 4,606,672 | A | * | 8/1986 | LeSire | 405/87 |
| 4,622,471 | A | * | 11/1986 | Schroeder | 290/42 |
| 4,735,525 | A | * | 4/1988 | Pengelly | 405/99 |
| 4,836,711 | A | * | 6/1989 | Sala et al. | 405/92 |
| 4,877,352 | A | * | 10/1989 | Tuttle et al. | 405/104 |
| 4,934,867 | A | * | 6/1990 | Cardis et al. | 405/87 |
| 5,092,707 | A | * | 3/1992 | Obermeyer | 405/92 |
| 5,171,102 | A | * | 12/1992 | De Wit | 405/101 |
| 5,178,490 | A | * | 1/1993 | Snowberger et al. | 405/102 |
| 5,255,999 | A | * | 10/1993 | Perslow | 405/87 |
| 5,678,956 | A | * | 10/1997 | Freelain | 405/99 |
| 5,709,502 | A | * | 1/1998 | Obermeyer | 405/87 |
| 5,713,699 | A | * | 2/1998 | Obermeyer et al. | 405/115 |
| 5,758,989 | A | * | 6/1998 | Snowberger | 405/80 |
| 6,132,140 | A | * | 10/2000 | Kullberg | 405/114 |
| 6,171,023 | B1 | * | 1/2001 | Townshend | 405/94 |
| 6,196,764 | B1 | * | 3/2001 | Bayssiguier | 405/102 |
| 7,037,039 | B1 | * | 5/2006 | Werts | 405/99 |
| 2003/0024865 | A1 | * | 2/2003 | Kezele et al. | 210/170 |
| 2003/0026659 | A1 | * | 2/2003 | Wu | 405/87 |
| 2003/0143027 | A1 | * | 7/2003 | Obermeyer et al. | 405/115 |
| 2003/0167696 | A1 | * | 9/2003 | Chen | 49/477.1 |
| 2003/0190193 | A1 | * | 10/2003 | Waters, Jr. | 405/110 |
| 2004/0005195 | A1 | * | 1/2004 | Winkler | 405/107 |
| 2004/0009041 | A1 | * | 1/2004 | Aughton et al. | 405/99 |
| 2004/0151546 | A1 | * | 8/2004 | Martinez | 405/40 |
| 2005/0100411 | A1 | * | 5/2005 | Rijlaarsdam | 405/107 |
| 2006/0072969 | A1 | * | 4/2006 | Obermeyer et al. | 405/115 |
| 2006/0140722 | A1 | * | 6/2006 | Wirz et al. | 405/31 |

FOREIGN PATENT DOCUMENTS

| | | | |
|---|---|---|---|
| FR | 2559807 | * | 2/1984 |
| FR | 2 803 312 A | * | 7/2001 |
| GB | 1275193 | * | 5/1972 |
| JP | 61-87009 | * | 12/1985 |
| JP | 60-226915 | * | 2/1986 |
| JP | 03-132510 | * | 6/1991 |

* cited by examiner

WATERTIGHT GATE HAVING GATE LEAF CONNECTED TO FOLDABLE SUPPORT

CROSS-REFERENCE TO RELATED APPLICATIONS

This application is the national phase of International (PCT) Patent Application Serial No. PCT/GB02/05067, filed Nov. 11, 2002, published under PCT Article 21(2) in English, which claims priority to and the benefit of British Patent Application No. 0127216.0, filed Nov. 13, 2001, the disclosures of which are incorporated herein by reference.

FIELD OF THE INVENTION

The present invention relates to the field of watertight gates. In particular, it relates to watertight gates for use within a port or a canal lock system.

BACKGROUND OF THE INVENTION

Locks provide fairly simple devices that allow boats to go up and down from one level to another within a canal. A schematic representation of a canal lock 1 is presented in FIG. 1. The lock essentially consists of a watertight chamber 2, two gate sills 3 and two Mitre gates 4 located at either end of the chamber 2, themselves comprising of two gate leaves 5. Sluice valves 6, sluice chambers 7 and water valves 8 are incorporated within these Mitre gates 4 to allow the water to enter into the chamber 2, filing it, or allowing water out of the chamber 2 draining it. Associated with each Mitre gate 4 is a hand winch mechanism or a hydraulic cylinder 9, a gate sluice control 10 and a gate recess 11.

As is well known in the art the systematic control of the position of the sluice valves 6, sluice chambers 7 and water valves 8 allow for a boat 12 to move through the lock 1 in either direction as desired. The same Mitre gate 4 systems are also traditionally employed as watertight gates for ports.

In order to operate correctly the Mitre gates 4 require to be watertight. This is achieved through the employment of a heel post, Mitre post and seals as are well known in the art. Hydraulic pressure that is a direct result of the difference in the water levels from the upper side and lower side of the Mitre gate 4, acts to maintain the watertight seal. The hydraulic pressure forces the lower side of the gate leaves 5 against the gate sill 3 forming a seal while the Mitre post provides the required seal between the gates leaves 5.

Traditionally the heel post, Mitre post and seals are constructed using hardwood such as greenheart or ekki, as these are resistant to marine borers and other forms of decay. As well as providing the sealing means, the heel post and the Mitre post also act as the load bearing components for the structure.

Two major disadvantages have developed with the use of the aforementioned Mitre gates 4. The first is a result of the dependency for hydraulic pressure to maintain the gates 4 in the closed watertight position. Water levels are not consistent all year round and more significantly global warming has seen average water levels rise over recent years. Therefore, the efficiency of the Mitre gate 4 is seasonally dependent and in general the overall efficiency is being reduced due to global warming effects.

Attempts to provide a solution to this reverse head of water pressure include the incorporation of a set of reverse Mitre gates or the incorporation of additional support struts. The first solution is expensive, as a whole new gate is required along with major engineering to the surrounding area. In practice, this system also requires a sensor to indicate to an operator that a reverse head is forming on the first Mitre gate, such that the reverse Mitre gate can be closed. However, due to lack of use and regular maintenance such systems are prone to mechanical failure that is only discovered at the time when the gate is most needed.

The disadvantage of employing additional support struts is two-fold. This system again requires a sensor to advise the gate operational staff that the strut has to be engaged. Secondly, it is generally deployed to the upper edge of the gate leaves, causing a pivotal action, and thus reducing the efficiency of the heel post, sill and Mitre post.

A more effective solution has been the development of a sector gate system. Although an improvement on the present form of Mitre gates, these systems are extremely expensive, as they require extensive engineering of the support structure so as to enable incorporation of the required sector recesses. Typical construction and installation costs amount to around £0.5 Million for construction of the gates but rise by around £7 Million for the development of the sector recesses.

The second major disadvantage of the Mitre gates 4 is the requirement to be constructed to a high degree of tolerance. Once installed the gate 4 has little allowance for adjustment to compensate for misalignment at the gate sills 3 or at the Mitre post. In addition, wear and tear on the heel posts and the Mitre posts results during normal opening and closing of the gate 4. This wear and tear tends to be uneven due to the load caused by the swinging weight of the gate being concentrated in particular areas and so the efficiency of the gate 4 deteriorates with use.

SUMMARY OF THE INVENTION

It is an object of an aspect of the present invention to provide a watertight gate for use in a port or canal that does not depend on hydraulic pressure of the associated water levels in order to maintain the required watertight seal.

It is a further object of an aspect of the present invention to provide a watertight gate for use in a port or canal that allows for adjustment in order to overcome problems of alignment and reduced efficiency through wear and tear.

A yet further object of an aspect of the present invention is to provide a watertight gate for use in a port or canal that can be incorporated with existing gate sill and gate recess facilities.

According to a first aspect of the present invention there is provided a watertight gate mechanism for use in a port or canal comprising one or more gate leaves, at least one foldable support structure and at least one gate position control means associated with each gate leaf, wherein the gate position control means interacts with the foldable support structure so as to move the associated gate leaf between an open and a closed position.

Preferably the foldable support structure is in a folded position when the associated gate leaf is in the open position and an unfolded position when the associated gate leaf is in the closed position.

Preferably the watertight gate mechanism further comprises a gate sill and a gate recesses associated with each gate leaf.

Most preferably when the gate leaves are in the closed position the watertight gate mechanism provides a watertight seal between the gate leaves and the gate sill that is independent of the hydraulic water pressure associated with water levels on either side of the gate mechanism.

Most preferably when the gate leaves are in the open position each gate leaf, and associated foldable support structures and gate position control means are all housed within the associated gate recess.

Preferably the gate leaves comprises at least two watertight seals. Most preferably these watertight seals comprise flexible rubber such as neoprene although any other suitable material may be employed.

Most preferably the gate leaves further comprise valve means that allow for the regulated flow of water through the watertight gate mechanism.

Preferably the support structure comprises at least two support frames, two or more frame hinges and a plurality of adjustable mounts, wherein the frame hinges connect two support frames so providing a pivot means for the support frames relative to each other.

Optionally a support tube connects the frame hinges.

Most preferably the support structure is connected at opposite ends, by adjustable mounts, to the associated gate leaf and the gate recess, respectively.

Preferably the adjustable mount comprises a tubing section, a screw mechanism, an adjustable rod, a locator and a fastening means wherein the screw mechanism adjustable rod and fastening means allow the length of the adjustable mount to be altered.

Preferably the gate position control means comprises a hydraulic cylinder. Alternatively the gate position control means comprises a motor employed to control the angle of the first support frame relative to the gate recess about a substantially vertical axis.

Preferably the hydraulic cylinder is attached at opposite ends to the gate recess and the foldable support frame, respectively.

Alternatively the hydraulic cylinder is attached at opposite ends to the gate leaf and the foldable support frame, respectively.

In a further alternative the hydraulic cylinder is housed within the gate recess and is employed to control the angle of a control arm relative to the gate recess about a substantially vertical axis.

Preferably the control arm is attached at opposite ends to a slidable mount located in the gate recess and the foldable support frame, respectively.

According to a second aspect of the present invention there is provided a method for deploying and maintaining a watertight gate mechanism for use in a port or canal comprising the steps:

1) Deploying gate leaves with associated foldable support structures and gate position control means with a gate sill and a gate recess.
2) Altering the position of the foldable support structure so as to maximise the efficiency of the seals of the watertight gate mechanism.
3) Periodically repeating the step of altering the foldable support structure so as to compensate for the effect of wear and tear of gate components on the efficiency of the watertight gate mechanism.

Most preferably the gate leaves, associated foldable support structures and gate position control means are deployed with re-cycled gate sills and recesses from existing canal locks or port gates.

Preferably the foldable support structure is attached at opposite ends to a gate leaf and the associated gate recess by adjustable mounts wherein the adjustable mounts provide the means for altering the position of the foldable support structure.

BRIEF DESCRIPTION OF THE DRAWINGS

Embodiments of the present invention will now be described by way of example only with reference to the accompanying figures, in which:

FIG. 2 presents a plan elevation of:

(a) a watertight gate mechanism;

(b) a second embodiment of the watertight gate mechanism;

(c) a third embodiment of the watertight gate mechanism; and (d) a fourth embodiment of the watertight gate mechanism in accordance with aspects of the present invention.

Figure 1:
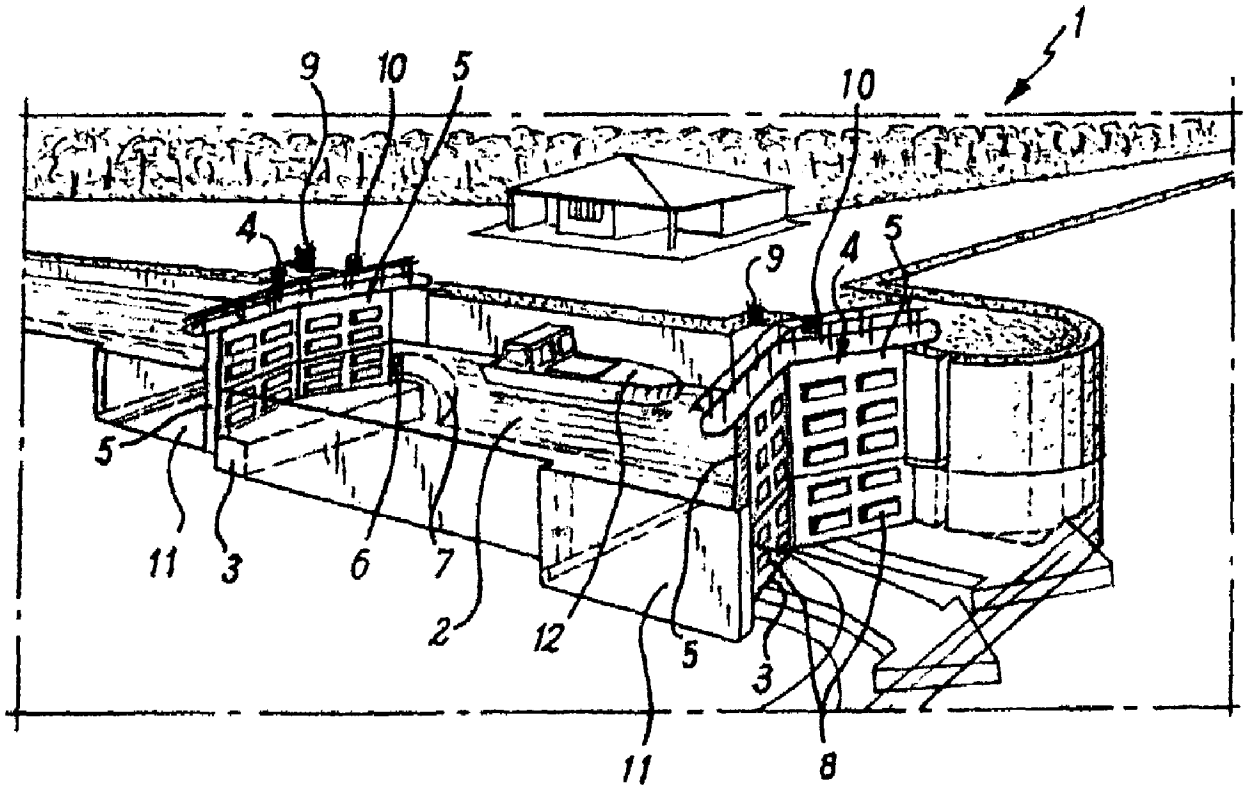
Fig. 1 (Prior Art)
FIG. 1 presents a schematic illustration of traditional Mitre gates incorporated within a canal lock.
Figure 2A:
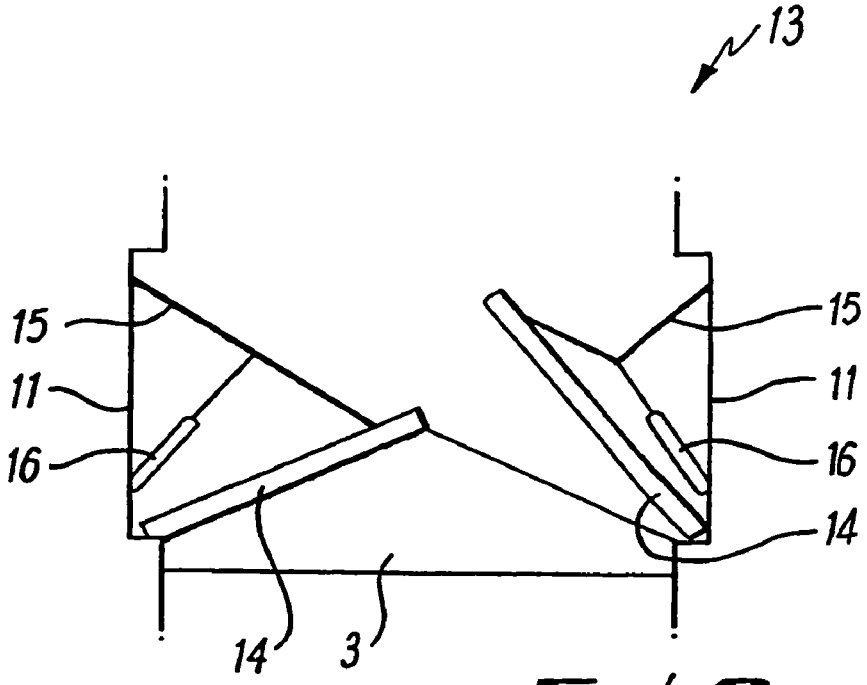
Figure 2B:
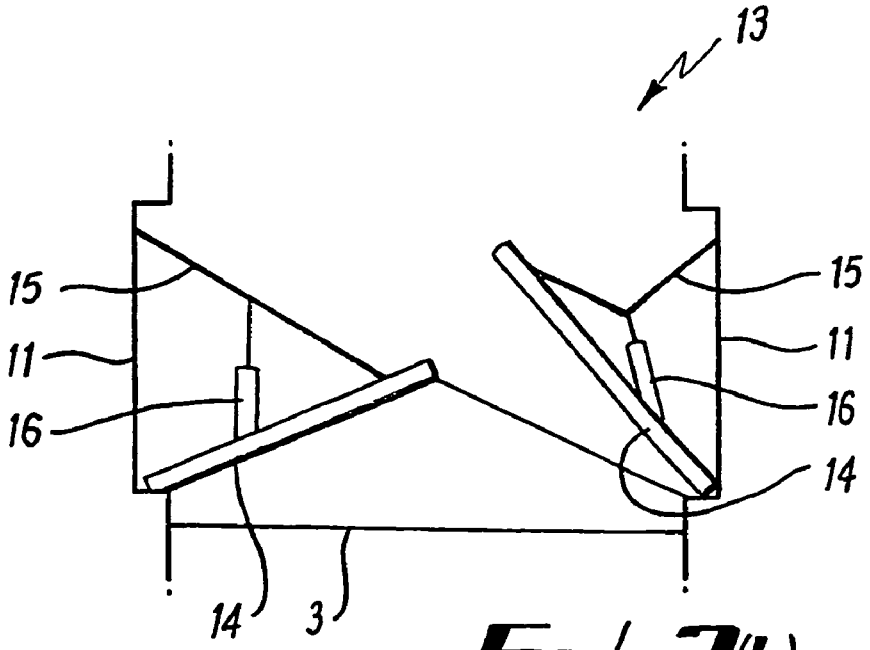
Figure 2C:
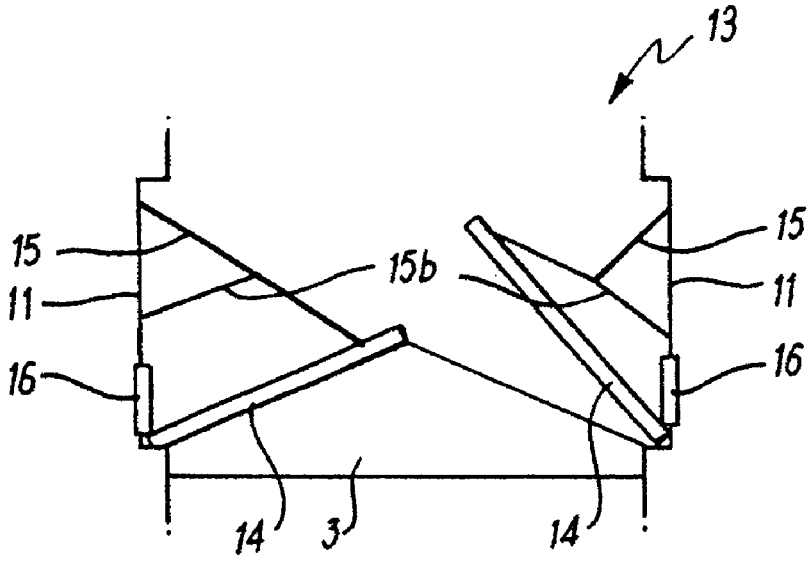
Figure 2D:
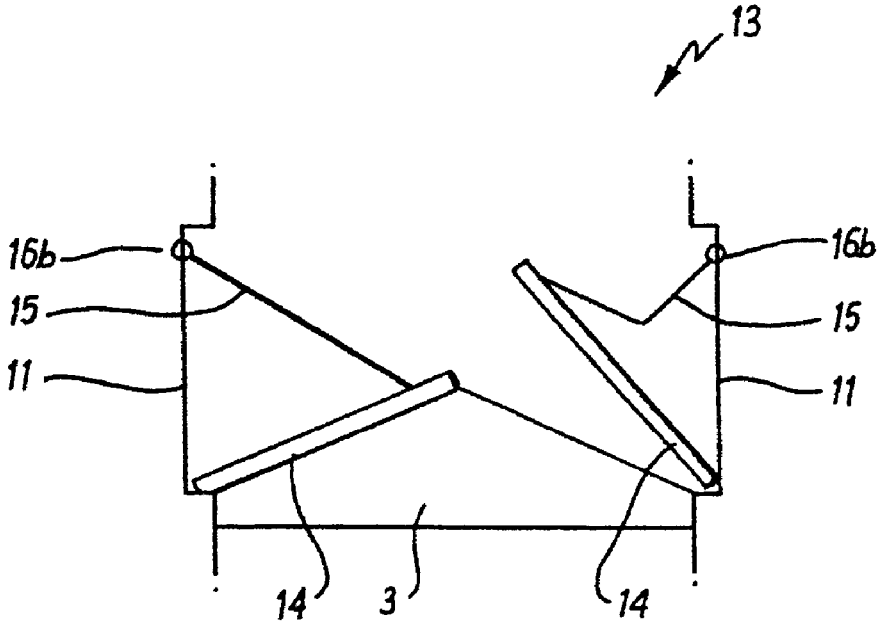
Figure 3:
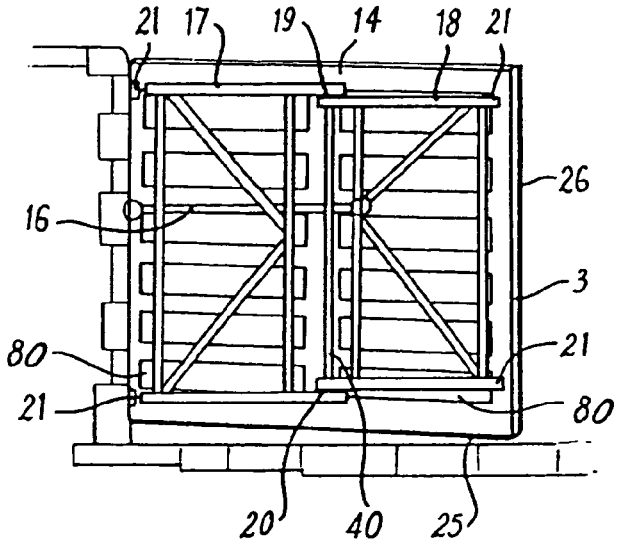
Figure 4A:
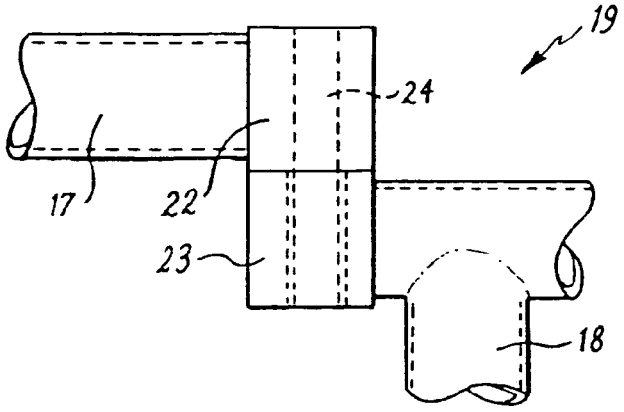
Figure 4B:
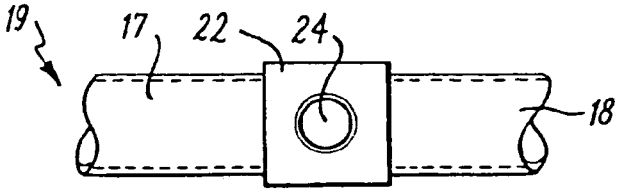

FIG. 3 presents a side elevation of a gate leaf of the watertight gate mechanism of FIG. 2(*a*);

FIG. 4 presents detail of a frame hinge employed in the present invention in:

(a) a side elevation;

(b) a plan elevation; and

Figure 5:
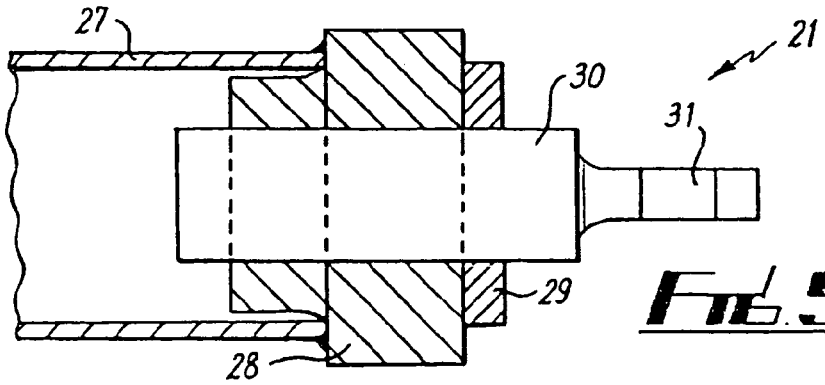

FIG. 5 presents a schematic illustration of the adjustable mounts employed in the present invention.

DETAILED DESCRIPTION OF THE PREFERRED EMBODIMENTS

FIG. 2(*a*) presents a plan view of the watertight gate mechanism 13 in accordance with the present invention. The gate mechanism 13 can be seen to comprise two gate leaves 14, two support structures 15 and two hydraulic control cylinders 16. The gate leaves 5 comprise valve means (not shown) that provide a facility for allowing the regulated flow of water through the watertight gate mechanism.

Further detail of one side of the watertight gate mechanism 13 shown in FIG. 2(*a*) can be seen in FIG. 3. The support structure 15 can be seen to further comprise two support frames 17 and 18 that are pivotally connected at one end via two frame hinge 19 and 20. The opposite ends of the support frames 17 and 18 are attached to the associated gate recess 11 and the gate leaf 14 respectively, via adjustable mounts 21. A vertical bar 40 is incorporated between the frame hinges 19 and 20 to ensure a common axis of rotation between the support frames 17 and 18. Additionally, the gate leaf 14 comprise valve means 80 that provide a facility for allowing the regulated flow of water through the watertight gate mechanism 13.

FIG. 4 presents a side and plan elevation of the top frame hinge 19 employed in the present invention. The top bars of both of the support frames 17 and 18 comprise locators 22 and 23, employed to provide means for locating a securing pin 24. The securing pin fastens the top of support frames 17 and 18 together while providing a pivot means allowing the support frames to pivot relative to each other. A similar hinge 20 is employed to connect the lower sides of the support frames 17 and 18.

The gate leaves 14 further comprises a sill seal 25 and two vertical seals 26 all being made from a flexible rubber material such as neoprene. The sill seal 25 interacts with the sill 3 so as to provide the required watertight seal when the gate leaves 14 are closed. In a similar fashion, the vertical seals 26 are incorporated along the vertical lengths of each gate leaf 14. These vertical seals provide a watertight seal between the gate leaves 14 when they are in their closed position as well as between a gate leaf 14 and its associated gate recess 11.

It is the employment of the hydraulic cylinder 16, attached between the support structure 15 and the gate recess 11 that provides for the control of the position of the associated gate leaf 14. When fully extended the gate leaf 14 is in the closed position as depicted in FIG. 3, and on the left-hand side of FIG. 2(*a*). However, when required to be opened the hydraulic cylinder 16 contracts causing the support frames 17 and 18 to pivot relative to each other as shown on the right-hand side of FIG. 2(*a*). This results in the support structure 15 folding up upon itself, causing the gate leaf 14 to pivot so as to become housed completely within the gate recess 11.

Although in this particular embodiment the hydraulic control cylinder 16 is attached to the second support frame 18 it could equally be adapted so as to interact in a similar fashion with the first support frame 17.

FIG. 2(*b*) presents an alternative embodiment for the watertight gate mechanism 13. In this embodiment the hydraulic cylinders 16 connect directly to the gate leaves 14 instead of the gate recess 11 as shown in FIG. 2(*a*).

A third embodiment for the watertight gate mechanism 13 is presented in FIG. 2(*c*). Here the hydraulic control cylinder 16 is mounted completely within the gate recess 11 and is employed to operate an arm 15*b* that connects between the support structure 15 and a slidable mount (not shown). Thus as the hydraulic control cylinder 16 moves between a fully extended position and a fully retracted position the gate leave 5 moves between it's closed and open positions, respectively.

A fourth embodiment for the watertight gate mechanism 13 is presented in FIG. 2(*d*). In this embodiment a motor 16*b* mounted within the gate recess 11 is employed to control the angle of the section of the support structure 15 connected to the motor 16*b*. Thus by varying this angle a gate leaf 5 can be moves between it's closed and open positions as appropriate.

In addition to the support structure 15 acting as a compact control means for the position of the gate leaf 14 it also provides support for the load experienced by the gate leaf 14. In particular the support structure 15 can act equally well in tension or compression so as to support the gate leaf 14 independently of the relative water levels on either side of the gate mechanism 13. As a direct consequence of the present design the hydraulic cylinder 16 does not itself experience a direct load. This offers the advantage of minimising the wear and tear on this controlling component.

FIG. 5 presents a schematic illustration of the adjustable mounts 21 employed for mounting the gate support structures 15 to the gate leaves 14 and the gate recesses 11, where appropriate. These adjustable mounts 21 comprise a tubing section 27, a screw mechanism 28, a lock nut 29 and an adjustable rod 30. Within the adjustable rod 30 there is machined a locator 31 for receiving a securing pivot pin (not shown) associated with a particular gate support frame 17 and 18.

When deployed in situ the adjustable mounts 21 provide a means for fine adjustment of the relative position of the gate leaves 14. Through the combination of the lock nut 29 and the adjustable rod 30 the adjustable mounts 21 can expand or retract as required. This process can also be repeated during the lifetime of the watertight gate 13 so as to compensate for the detrimental effects on alignment caused by wear and tear on the watertight seals 25 and 26.

Aspects of the present invention have the advantage that they provide a watertight gate for use in a port or canal that does not depend on hydraulic water pressure in order to maintain the required watertight seals. In addition the watertight gate removes any need for reverse head sensors in order to alert a user to the changing water levels, as are required for many of the systems described in the Prior Art.

It is a further advantage of aspects of the present invention to provide a watertight gate, for use in a port or canal that provides a means for adjustment of the relative position of the gate leaves. Such adjustment means provide a way of overcoming alignment problems and reduced sealing efficiency caused by wear and tear on the gate components.

A further major advantage of aspects of the present invention is that it provides a watertight gate that may be incorporated with existing port or canal gates systems. Such watertight gates reduce the requirement for extensive on site engineering and so significantly reduce the costs incurred in the construction and deployment of such gates.

The foregoing description of the invention has been presented for purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

1 Canal Lock
2 Watertight Chamber
3 Gate Sills
4 Mitre Gates
5 Gate Leaves
6 Sluice Valves
7 Sluice Chambers
8 Water Valves
9 Hand Winch Mechanism or Hydraulic Cylinder
10 Gate Sluice Control
11 Gate Recess
12 Boat
13 Watertight Gate Mechanism
14 Gate Leaves
15 Support Structures
16 Hydraulic Control Cylinders
17 First Support Frame
18 Second Support Frame
19 Frame Hinge
20 Lower Frame Hinge
21 Adjustable Mounts
22 First Locator
23 Second Locator
24 Securing Pin
25 Sill Seal
26 Inter Gate Seal
27 Tubing Section
28 Screw Mechanism
29 Lock Nut
30 Adjustable Rod
31 Adjustable Mount Locator

The invention claimed is:

1. A watertight gate for use in a port or canal comprising:

(a) at least one gate leaf;

(b) at least one gate position controller; and (c) at least one foldable support structure connected to both the at least one gate leaf and the at least one gate position controller;

wherein the operation of the at least one gate position controller acts to control the at least one foldable support structure so as to selectively pivot the at least one gate leaf to an open position or to a closed position, thus enabling the watertight gate to be repeatably opened and closed; and wherein the at least one foldable support structure comprises at least two support frames, two or more frame hinges and a plurality of adjustable mounts, wherein the frame hinges connect the two support frames so providing for the support frames to pivot relative to each other.

2. The watertight gate of claim 1 wherein the adjustable mount comprises a tubing section, a screw mechanism, an adjustable rod, a locator and a fastening means wherein the screw mechanism, adjustable rod and fastening means allow the length of the adjustable mount to be altered.

3. The watertight gate of claim 1 wherein a support tube connects the frame hinges.

* * * * *